US006547488B2

(12) United States Patent
Imbrigiotta

(10) Patent No.: US 6,547,488 B2
(45) Date of Patent: Apr. 15, 2003

(54) GREENS MAINTENANCE SYSTEM

(76) Inventor: Robert A. Imbrigiotta, 2010 NE. 65th St., Fort Lauderdale, FL (US) 33308

( * ) Notice: Subject to any disclaimer, the term of this patent is extended or adjusted under 35 U.S.C. 154(b) by 0 days.

(21) Appl. No.: 09/795,198

(22) Filed: Feb. 28, 2001

(65) Prior Publication Data

US 2002/0119007 A1 Aug. 29, 2002

(51) Int. Cl.[7] ..... E02B 11/00; A01G 25/00
(52) U.S. Cl. ..... 405/36; 47/1.01 T; 52/169.4
(58) Field of Search ..... 405/36; 47/33, 47/1.01 T; 52/169.4, 102

(56) References Cited

U.S. PATENT DOCUMENTS

| | | | | |
|---|---|---|---|---|
| 1,977,021 A | * | 10/1934 | Spencer | 47/33 |
| 2,061,631 A | * | 11/1936 | Law | 47/30 |
| 2,837,866 A | | 6/1958 | Esmay et al. | |
| 2,960,797 A | | 11/1960 | Frehner | |
| 3,134,233 A | | 5/1964 | Morrison | |
| 3,269,125 A | | 8/1966 | Moore | |
| 3,314,193 A | | 4/1967 | Chancellor | |
| 3,343,301 A | | 9/1967 | Adelman | |
| 3,415,013 A | * | 12/1968 | Galbraith | 47/33 X |
| 4,372,079 A | * | 2/1983 | Trageser | 47/33 |
| 4,620,817 A | | 11/1986 | Cushing | |
| 4,644,685 A | * | 2/1987 | Tisbo et al. | 47/33 |
| 4,934,404 A | | 6/1990 | DeStefano | |
| 5,121,569 A | * | 6/1992 | Thomas | 47/33 |
| 5,192,426 A | | 3/1993 | DeCoster et al. | |
| 5,234,286 A | | 8/1993 | Wagner | |
| 5,322,387 A | | 6/1994 | Heine et al. | |
| 5,342,144 A | | 8/1994 | McCarthy | |
| 5,499,891 A | * | 3/1996 | Klenert | 405/284 |
| 5,519,970 A | | 5/1996 | Reum et al. | |
| 5,730,179 A | | 3/1998 | Taylor | |
| 5,823,711 A | | 10/1998 | Herd et al. | |
| 5,862,629 A | * | 1/1999 | Sulyman | 47/33 X |
| 6,108,969 A | | 8/2000 | Danna et al. | |
| 6,449,897 B1 | * | 9/2002 | Gaston | 47/33 |

FOREIGN PATENT DOCUMENTS

DE 3837815 * 12/1989

* cited by examiner

*Primary Examiner*—David Bagnell
*Assistant Examiner*—Sunil Singh
(74) *Attorney, Agent, or Firm*—Laurence A. Greenberg; Werner H. Stemer; Ralph E. Locher

(57) ABSTRACT

The greens maintenance system is specifically directed to lawn areas with lawn grass covering underlying soil, and the soil having a given seepage rate defined by an amount of water allowed to seep into the soil per unit of time. The system includes a water collection device disposed to collect runoff water during and immediately after precipitation exceeding a seepage rate of the soil and to collect runoff water running off from surfaces adjacent the lawn area, such as roofs, driveways, and the like. A storage container communicates with the water collection device and stores the runoff water collected by the water collection device. An active irrigation system communicates with the storage container, for irrigating the lawn area during periods of reduced precipitation. Elongate dividers are strategically placed in the soil underlying the lawn surface for reducing a velocity of the water running across the lawn area.

10 Claims, 2 Drawing Sheets

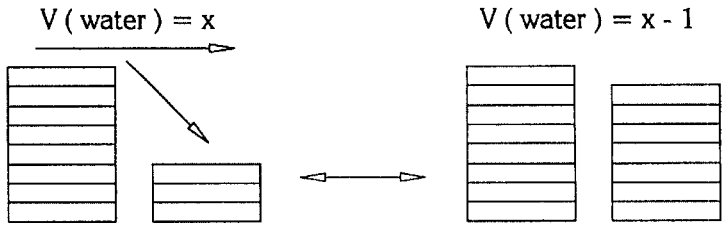
Fig. 1
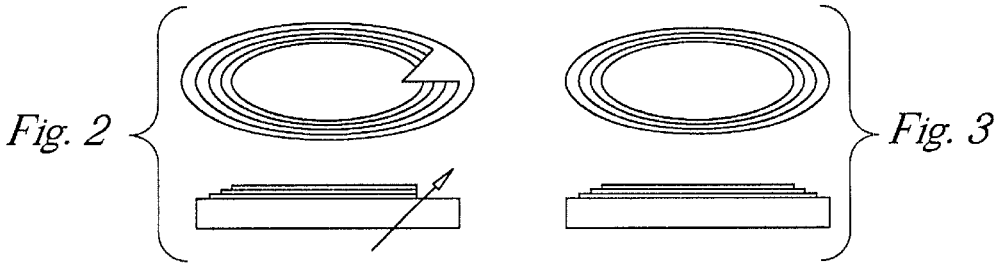
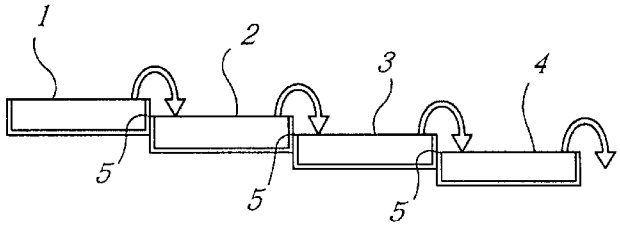
Fig. 4
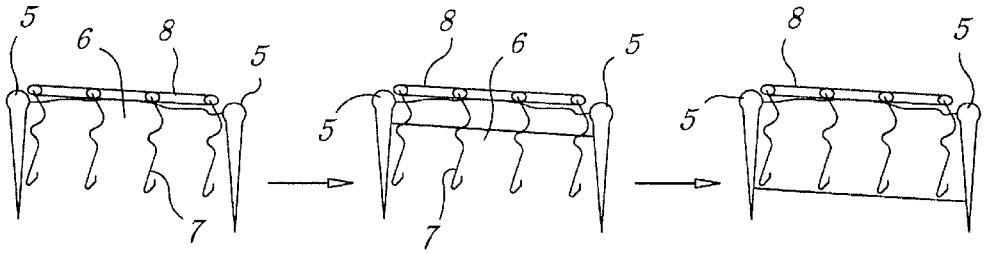
Fig. 5

GREENS MAINTENANCE SYSTEM

BACKGROUND OF THE INVENTION

FIELD OF THE INVENTION

The invention relates to horticulture and greens maintenance. More specifically, the invention pertains to a system for maintaining proper irrigation for lawns and gardens. The invention also pertains to a water recycling and diverter system for greens maintenance.

As more and more rural areas are developed into urban and suburban neighborhoods, wetlands and barren highlands are converted into lawn surfaces surrounding covered dwellings and into asphalt surfaces surrounding the lawns. The lawns require constant irrigation. Even in the subtropical climates along the sunbelt and along the east coast with its superior humidity, however, proper and sufficient irrigation is not always ensured. One of the reasons is that typical dry cycles of several weeks often exceed the allowable dry cycle of most popular lawn grasses. Another reason is that lawn sprinkler systems are often incorrectly placed to reach all areas of a particular lawn system and the underlying soils are non-uniformly wetted, or the sprinkler systems are not properly operated in terms of adequate wetting and of frequency of operation. Furthermore, widespread water shortages are quite common in the highly populated regions of the Southwest, as well as in the Southeast and Florida, so that even Sprinkler-equipped greens are often dried out to such an extent that the lawn grasses are severely damaged.

U.S. Pat. No. 5,192,426 to DeCoster et al. describes a water reclamation system for landscape irrigation in which reusable household runoff water is collected and used for landscape sprinkler application. U.S. Pat. No. 4,934,404 to DeStefano describes a water management system in which roof runoff and the like is recycled for use in a sprinkler system.

A further reason for the non-uniform wetting of soil underlying lawn grasses, even if sufficient quantities of water are supplied, is found in the fact that rain water is often quickly collected in depressions and drained from low-lying areas. The above-described prior art systems do not provide a solution to these problems.

SUMMARY OF THE INVENTION

It is accordingly an object of the invention to provide a greens maintenance system, which overcomes the above-mentioned methods of this general type and which ensures that lawn grasses are evenly and sufficiently irrigated with a minimum in water and energy usage.

With the foregoing and other objects in view there is provided, in accordance with the invention, a greens maintenance system for a lawn system having a given lawn area with lawn grass substantially covering underlying soil, and the soil having a given seepage rate defined by an amount of water allowed to seep into the soil per unit of time. The greens maintenance system comprises the following elements:

a water collection device disposed to collect runoff water during and immediately after precipitation exceeding a seepage rate of the soil and to collect runoff water running off from surfaces adjacent the lawn area;

a storage container communicating with the water collection device and storing the runoff water collected by the water collection device;

an active irrigation system communicating with the storage container, for irrigating the lawn area during periods of reduced precipitation; and a plurality of elongate dividers strategically placed in the soil underlying the lawn surface for reducing a velocity of the water running across the lawn area.

The active irrigation system mentioned above may simply be an outlet valve which allows the water from the storage container to outflow onto the lawn surface, or it may be a complete integrated sprinkler system. The sprinkler system, therefore, would not "waste" expensive city water or run a well pump, but utilize water that would otherwise have been lost.

In accordance with an added feature of the invention, the storage container is formed with an inlet connected to receive water running off a building adjacent the lawn area. Typically, roof runoff is "lost" in that the water is pumped away by municipal services or the like. Collecting this extra amount of water allows using the roof runoff and runoff from adjacent non-lawn areas to be utilized in the irrigation of the lawn.

In accordance with an additional feature of the invention, the elongate dividers are disposed to have their top edges aligned with the level of the soil underlying the lawn surface. Alternatively, they may project slightly above the soil underlying the lawn surface but below the lawn surface defined by the upper lawn grass level. The dividers are thus hidden from view and they do not disturb during the trimming of the lawn.

There is further provided, in accordance with the invention, an improvement in a lawn maintenance system of the type having a lawn surface extending substantially continuously and smoothly from a first geodetic level to a second geodetic level. The improvement comprises a plurality of elongate dividers strategically placed in a soil underlying the lawn surface for reducing a velocity of the lawn-irrigating water running from the first geodetic level to the second geodetic level.

In accordance with another feature of the invention, the elongate dividers are oriented to extend substantially transverse to a line defined by a direction of the water running from the first geodetic level to the second geodetic level. It is advantageous for the elongate dividers to be placed to define a cascade system cascading from the first geodetic level to the second geodetic level.

In accordance with again another feature of the invention, the elongate dividers are oriented to extend obliquely to a line defined by a direction of the water running from the first geodetic level to the second geodetic level. This feature allows water running across the lawn to be channeled towards areas which require more water or which do not generally receive sufficient irrigation.

With the above and other objects in view there is further provided, in accordance with the invention, a method of improving a lawn irrigation maintenance system of the type having a water source for irrigating a lawn surface extending with a given gradient from a first geodetic level to a second geodetic level. The method comprises integrating elongate dividers in a soil underlying the lawn surface for reducing a velocity of lawn-irrigating water running along the given gradient from the first geodetic level to the second geodetic level and for increasing a remain time of the water on the lawn surface.

As noted above, it is advantageous to strategically place the dividers and to orient them substantially transversely to a direction prescribing the gradient and/or obliquely to the gradient line. As also noted, the elongate dividers are placed to project above the soil underlying the lawn surface and below the lawn surface defined by the upper lawn grass level. This renders the dividers substantially invisible, while they retain their full functionality.

Other features which are considered as characteristic for the invention are set forth in the appended claims.

Although the invention is illustrated and described herein as embodied in a greens maintenance system, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWING

FIG. 1 is a diagrammatic view of two different landscape gradients;

FIG. 2 is a diagrammatic top view and a related side view showing a non-uniform landscaping gradients;

FIG. 3 is a diagrammatic top view and a related side view showing non-uniform landscaping gradients;

FIG. 4 is a diagrammatic side view illustrating partial lawn sectioning with a cascade concept;

FIG. 5 is a diagrammatic side view illustrating a time sequence of soil watering in a single lawn segment;

DESCRIPTION OF THE PREFERRED EMBODIMENTS

Figure 6:
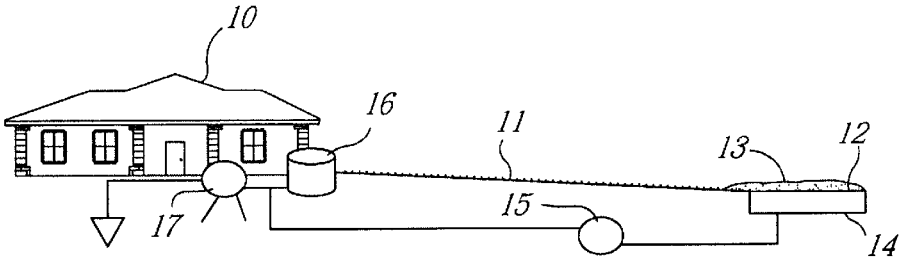
FIG. 6 is a diagrammatic side view of a rainwater recycling and greens maintenance system according to the invention.

Referring now to the figures of the drawing in detail and first, particularly, to FIG. 1 thereof, water flows across lawn surfaces at various velocities. The water velocity V is directly proportional to the slope of the landscaping surface. In other words, the steeper the lawn surface (in geodetic terms), the faster water will flow across the surface and run off from the surface. On the other hand, the degree of seepage of the water into the soil depends essentially on the composition of the soil and the amount of time the water remains on a given area of the lawn. Assuming that the composition of the soil is approximately uniform throughout a specific greens area, therefore, it can be shown that the amount of seepage of water into the soil is a function of the water velocity V which, in turn, is directly proportional to the gradient of the landscaping surface.

With reference to FIG. 2, the non-uniform gradient distribution about the greens area depicted would therefore, without more, lead to non-uniform wetting of the underlying soil. Such non-uniform wetting of the soil, of course, becomes evident in that the lawn grasses grow in a non-uniform pattern. Further, it may happen during particularly dry periods, that the lawn grasses in the flatter areas are sufficiently green, while the steeper areas already turn brown and gray.

The even gradient distribution about the greens area illustrated in FIG. 3 leads to decreased (or uniform) water velocity during wetting periods and, as a consequence, to more even wetting of the underlying soil. The result, of course, is a more uniform and healthier lawn surface.

FIG. 4 illustrates a novel cascade system, which can be utilized, in accordance with the invention, to provide for properly distributed and even wetting of the soil. A certain area of lawn is subdivided into individual segments 1–4. Dividers 5 are provided between the segments, so that the individual segments are subject to reduced flow velocity. The illustration in FIG. 4 is exaggerated in that the steps between the individual segments 1–4 need not be very pronounced or, in fact, they may be omitted altogether. It has been found that the water flow velocity V of the "above-surface" current of water reaches down into the lawn grass and at least to the upper surface of the underlying soil. The dividers 5, therefore, may be placed to only slightly project above the soil surface but remain well below the tips of the lawn grass leaves. In other words, the dividers remain hidden below the visible grass surface, yet they slow down the above-surface water current during rain and/or sprinkling.

This cascading principle is further illustrated in the sequential views of FIG. 5. There the dividers 5 reach down into the underlying soil 6 below the roots 7 of the lawn grass. The upper level of the grass is indicated by the continuous bar 8. For an observer of the lawn surface, the dividers 5 are not visible. The slope of the lawn segment (any of the segments 1–4 is illustrated in FIG. 5) as defined by the gradient bar 8 is smoothly continued to an adjacent segment.

The dividers 5, which may also be referred to as diverters, may be specifically manufactured for a given application or, in the alternative, standard landscape edging may be used as well. Such standard landscape edging is commercially available in rolls of continuous length or in standardized length strips.

As shown by the sequential views of FIG. 5, rainwater does not immediately flow off the illustrated segment, but it is corralled by the divider 5 and its remain time on the segment is increased. The segment fills up and overflows during a period of rain (or sprinkling, for that matter). As a result, the water is allowed to sufficiently and evenly wet the underlying soil.

In addition to uneven flow velocity distribution, there exist other known factors that lead to non-uniform and insufficient watering of lawns. Water is often wasted and thus prevented from properly wetting a given greens area in that the water, after flowing across the lawn, is collected and removed from the area through a sewer pump system. With reference to FIG. 6, for example, during a downpour, water flows off the roof of a building 10, it quickly flows across the grass or a driveway towards the lower-lying surfaces, such as a street 12. From there the water is pumped away by municipal services. Instead of being properly utilized to maintain the greens around the building 10, therefore, a substantial amount of water is "lost" and pumped away.

This situation is alleviated with the novel system proposed herein. The excess water 13 is collected through a collection header 14, and pumped back to a higher location into a holding tank 16. From there, the water is available for further watering during following dry periods. For that purpose, the tank 16 may be connected to a sprinkler system via a sprinkler pump 17. Also, it is advantageous for the tank 16 to be directly connected to receive the runoff from the roof of the building 10 through its roof gutters. It should be noted, of course, that the placement of the tank 16 is critical only with regard to the specific application. For example, if a sprinkler pump is used for subsequent watering from the tank 16, the latter may be placed at any location. If, on the other hand, subsequent wetting is effected without a pump, then the tank 16 must be geodetically located at a higher level than the highest outflow opening.

Figure 7:
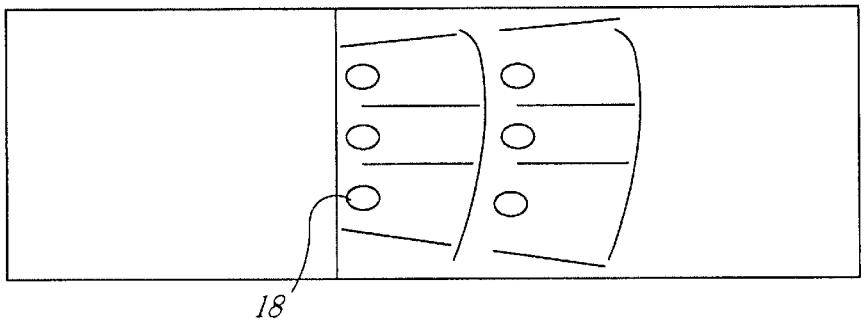
FIG. 7 is a plan view thereof.

FIG. 7 provides a plan view onto a lawn area which is provided with the novel divider system. Further, several outlet valves 18 are distributed in the lawn area. The valves 18 communicate with the storage tank 16 via corresponding diverter pipes.

Figure 8A:
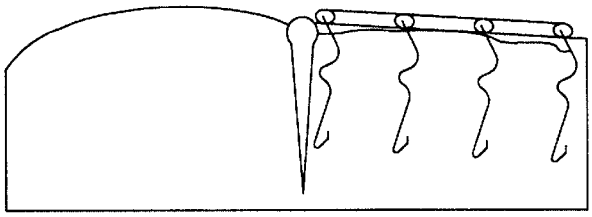
FIG. 8A is a diagrammatic side view of a lawn area adjacent a raised non-lawn area, such as a flower bed.

Referring now to FIG. 8A, water seepage may be prevented into adjacent raised non-lawn areas, such as flower beds and the like, by integrating edging dividers at the boundary.

Figure 8B:
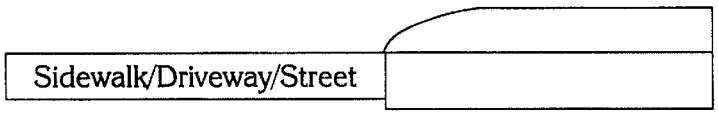
FIG. 8B is a diagrammatic side view of a lawn area adjacent a non-vegetation area, such as a sidewalk or the like without an edging boundary.
Figure 8C:
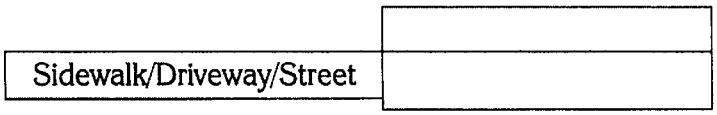
FIG. 8C is a diagrammatic side view of a lawn area adjacent a non-vegetation area, such as a sidewalk or the like, with an edging boundary.

FIGS. 8B and 8C illustrate how the lawn area may be bounded towards adjacent non-vegetation areas, such as a sidewalk or the like. The boundary of FIG. 8C is substantially more advantageous in that the lawn grows strong and healthy all the way to the border at the non-vegetation area, where an edging boundary is provided.

I claim:

1. A greens maintenance system for a lawn system having a given lawn area with lawn grass substantially covering underlying soil, and the soil having a given seepage rate defined by an amount of water allowed to seep into the soil per unit of time, the system comprising:

a water collection device disposed to collect runoff water during and immediately after precipitation exceeding a seepage rate of the soil and to collect runoff water running off from surfaces adjacent the lawn area;

a storage container communicating with said water collection device and storing the runoff water collected by said water collection device;

an active irrigation system communicating with said storage container, for irrigating the lawn area during periods of reduced precipitation; and a plurality of elongate dividers strategically placed in the soil underlying the lawn surface for reducing a velocity of the water running across the lawn area, said elongate dividers having an upper edge projecting to above the soil and below the lawn surface.

2. The system according to claim 1, wherein said storage container is formed with an inlet connected to receive water running off a building adjacent the lawn area.

3. The system according to claim 1, wherein said elongate dividers have upper edges disposed at substantially an equal level as the soil underlying the lawn surface.

4. In a lawn maintenance system having a lawn surface extending substantially continuously and smoothly from a first geodetic level to a second geodetic level, and wherein lawn-irrigating water runs from the first geodetic level to the second geodetic level, the improvement which comprises a plurality of elongate dividers strategically placed inside the lawn surface, with grass of the lawn disposed immediately adjacent said elongate dividers on both sides thereof, in a soil underlying the lawn surface and having an upper edge projecting to above the soil and below the lawn surface for reducing a velocity of the lawn-irrigating water running from the first geodetic level to the second geodetic level.

5. The lawn maintenance system according to claim 4, wherein said elongate dividers are oriented to extend substantially transverse to a line defined by a direction of the water running from the first geodetic level to the second geodetic level.

6. The lawn maintenance system according to claim 5, wherein said elongate dividers are placed to define a cascade system cascading from the first geodetic level to the second geodetic level.

7. The lawn maintenance system according to claim 4, wherein said elongate dividers are oriented to extend obliquely to a line defined by a direction of the water running from the first geodetic level to the second geodetic level.

8. A method of improving a lawn irrigation maintenance system having a water source for irrigating a lawn surface extending with a given gradient from a first geodetic level to a second geodetic level, the method which comprises integrating elongate dividers inside the lawn surface, with grass of the lawn disposed immediately adjacent said elongate dividers on both sides thereof, in a soil underlying the lawn surface and having an upper edge projecting to above the soil and below the lawn surface for reducing a velocity of lawn-irrigating water running along the given gradient from the first geodetic level to the second geodetic level and for increasing a remain time of the water on the lawn surface.

9. The method according to claim 8, which comprises placing the elongate dividers oriented substantially transversely to a direction prescribing the gradient.

10. The method according to claim 8, which comprises placing the elongate dividers to project above the soil underlying the lawn surface and below the lawn surface defined by the upper lawn grass level.

* * * * *